United States Patent [19]

Inoue

[11] Patent Number: 4,658,959

[45] Date of Patent: Apr. 21, 1987

[54] BIAS TAPE SUPPLY DEVICE

[75] Inventor: Shigehiro Inoue, Higashiosaka, Japan

[73] Assignee: Sanyo Kagaku Kogyo Kabushiki Kaisha, Osaka, Japan

[21] Appl. No.: 800,490

[22] Filed: Nov. 21, 1985

[30] Foreign Application Priority Data

Aug. 30, 1985 [JP] Japan ..... 60-189440

[51] Int. Cl.[4] ..... B65D 85/67

[52] U.S. Cl. ..... 206/409; 206/403

[58] Field of Search ..... 206/461, 409, 403, 818

[56] References Cited

U.S. PATENT DOCUMENTS

| | | | |
|---|---|---|---|
| 3,190,517 | 6/1965 | Rice | 206/409 |
| 3,237,327 | 3/1966 | Griggs | 206/818 |
| 3,512,633 | 5/1970 | Galan | 206/403 |
| 3,763,996 | 10/1973 | Shepherd | 206/818 |
| 3,820,738 | 6/1974 | Collins | 206/403 |
| 4,232,786 | 11/1980 | Ogura | 206/409 |
| 4,249,658 | 2/1981 | Ogura | 206/409 |
| 4,482,049 | 11/1984 | Kot, II | 206/818 |

FOREIGN PATENT DOCUMENTS

| | | | |
|---|---|---|---|
| 1159022 | 2/1958 | France | 206/818 |
| 1336770 | 7/1963 | France | 206/409 |
| 4611155 | 6/1967 | Japan | 206/403 |
| 477418 | 12/1937 | United Kingdom | 206/409 |
| 1024189 | 3/1966 | United Kingdom | 206/403 |

*Primary Examiner*—William Price
*Assistant Examiner*—Brenda J. Ehrhardt
*Attorney, Agent, or Firm*—Flynn, Thiel, Boutell & Tanis

[57] ABSTRACT

A bias tape supply device comprises a circular housing part made of synthetic resin for housing a bias tape and a guide part made of synthetic resin for delivering the bias tape from the housing part.

The housing part includes a top circular wall, a bottom circular wall, a cylindrical circumferential wall, and a magnet fixed outside the bottom circular wall.

The side walls gradually decrease in height from the base end of the guide part to the tip thereof.

The first side wall located adjoining the housing part is adapted at the tip thereof to be lower in height than the second side wall and is substantially triangle-shaped in a section thereof at the tip thereof.

Two projections are provided on the tip of the second wall, and a slit is notched in the second side wall located between the two projections.

The bottom circular wall of the housing part and the lower wall of the guide part are kept horizontal and formed integrally with each other.

The top circular wall of the housing part, and the upper wall and the first and second side walls of the guide part are formed integrally with each other.

The circumferential wall of the housing part is formed integrally with the top circular wall or the bottom circular wall of the housing part.

The circumferential wall of the housing part is covered with the top circular wall and the bottom circular wall of the housing part and thereafter they are fixed to each other.

5 Claims, 8 Drawing Figures

BIAS TAPE SUPPLY DEVICE

BACKGROUND OF THE INVENTION

1. Field of the Invention

The present invention relates to a bias type supply device adapted to supply a bias tape folded in two in a framing work with use of the bias tape which is employed as a hem for making dress and the like.

2. Description of the Prior Art

It is in general heretofore known in framing a fabric with a sewing machine to tentatively fasten one end of a bias tape to an edge of the fabric and finally fix it thereon while folding it over so as to cover a rear edge thereof.

Such prior framing operation however suffers from a drawback: The operation must be repeated twice, requiring a longer time therefor.

To solve such a problem, there is conventionally known a bias tape supply device as described below.

Referring to FIG. 7, a tape dispensing device as shown, which includes a molded structure bonded on a sheet of paper 4, which is provided with an integrally formed housing part 2 and a guide part 3 for a bias tape 1 comprising a thin plastic film. The bias tape 1 is housed in a housing part 2 and is commerically available in this form. The guide 3 is gradually reduced in height toward the tape delivery outlet and is adapted to cause the bias tape 1 to be bent down while being folded double upon delivery from the tip of the guide part 3. The guide part 3 has a slit 5 formed therein for passing an edge of the fabric therethrough when sewing it with a sewing machine.

The back side of the sheet of paper 4 is coated with a bonding agent and bonded on a prescribed portion of the sewing machine at a convenient location for framing the fabric.

Such a prior art bias tape supply device as described is a disposable type, and thus expensive.

The bias tape 1 in the prior art device is bonded and separated several times until it is utilized to the fullest, so that the bonding agent 6 may be damaged, resulting in insufficient bonding.

The tip of the guide part 3 is simply rectangle-shaped, so that the bias tape folded double is rotated in the guide part and the shape of the delivered bias tape is unsettled. Accordingly, the framing operation takes much time.

In addition, the bias tape comprises paper and a thin plastic film, so that it is fragile and difficult to be stored for a long time.

SUMMARY OF THE INVENTION

In view of the drawbacks with the conventional bias tape supply device, it is an object to provide a bias tape supply device adapted to permit a delivered bias tape to remain folded over at all times To achieve the above object, a bias tape supply device according to the present invention has a synthetic resin circular housing part for housing a bias tape and a synthetic resin guide part for delivering the bias tape from the housing part.

The housing part comprises a top circular wall, a bottom circular wall, a cylindrical circumferential wall, and a magnet fixed outside the bottom circular wall. The circumferential wall has a slit formed therein for passing a bias tape through it, at which a base end of the guide part is located.

The guide part comprises an upper wall, a lower wall, and first and second side walls provided on both sides of the foregoing upper and lower walls. The guide part is adapted to extend from the circumferential wall of the housing part to the outside thereof and be substantially L-shaped, while the foregoing side walls gradually decrease in height from the base end to the tip of the guide part. At the tip portion of the guide part, the first side wall of the guide part located in the vicinity of the housing part is adapted to be low in height, while the second side wall is adapted to be higher than the first one, thereby giving the tip portion of the guide part a substantially triangle-shaped cross-section. Two projections are provided on the tip of the second side wall extending generally toward the firstside wall, and a slit is formed in the second side wall between the two projections.

The bottom circular wall of the housing part and the lower wall of the guide part are kept horizontal, and parallel to each other and are integrally assembled. Likewise, the top circular wall of the housing part and the upper wall, and the first and second side walls of the guide part are integrally constructed, while the circumferential wall of the housing part is also formed integrally with the top circular wall, or, alternatively, the bottom circular wall of the housing part.

The circumferential wall of the housing part is covered with the top circular wall or the bottom circular wall of the housing part, and fixed.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

In making a dress with a fabric, some damage may result if an edge of the dress is left as it is, so that it is beneficial that a bias tape be folded in two for holding the edge from both sides thereof and fixing the edge with thread. Namely, provided the bias tape is supplied being previously folded in two, the dress edge can be fixed with thread only at a time and thus be very convenient.

The bias tape supply device according to the present invention is adapted to be freely mounted and demounted in a prescribed position on a sewing machine and to be capable of supplying a bias tape in a folded over state.

Figure 1A:
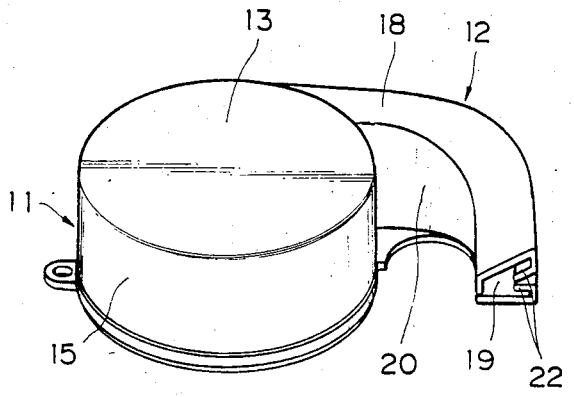
FIGS. 1(A), (B) are perspective views illustrating a bias tape supply device according to the present invention.
Figure 1B:
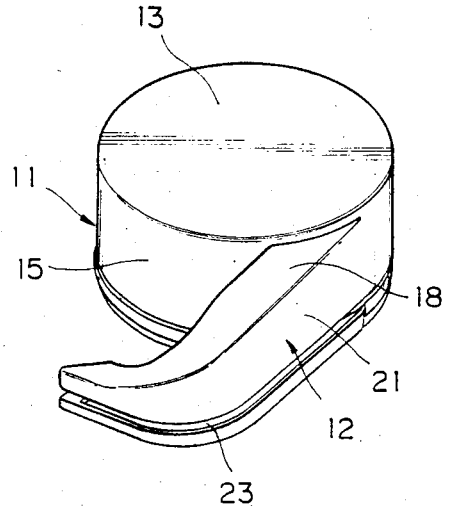
Figure 2:
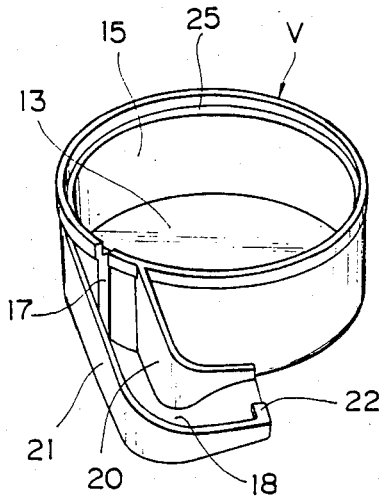
FIG. 2 is a perspective view illustrating the interior of upper housing and guide part of the device.
Figure 3:
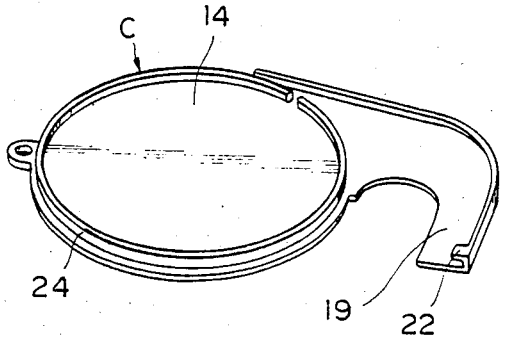
FIG. 3 is a perspective view illustrating the same on the bottom cover side of the device.

Referring to FIGS. 1 to 3, the bias tape supply device comprises a synthetic resin circular housing part 11 for housing a bias tape T (shown in FIG. 5) and a synthetic resin guide part 12 for delivering the bias tape T from the housing part 11.

The housing part 11 has a top circular wall 13, a bottom circular wall 14, a cylindrical circumferential wall 15, and a magnet 16 fixed outside the bottom circular wall 14.

A slit 17 is formed in the circumferential wall 15 for passing the bias tape T therethrough, and a base end of the guide part 12 is positioned at the slit 17.

The guide part 12 comprises an upper wall 18, a lower wall 19, and a first and second side walls 20, 21 provided on both sides of the upper and lower walls, which extend as a whole from the circumferential wall 15 of the housing part 11 to a point distant therefrom forming a substantially L-shaped guide. The first side wall 20 and the second side wall 21 of the guide part 12 gradually decrease in height from the base to the tip of the guide part 12, and at the tip portion of the guide part, the first side wall 20 located near the housing part 11 is adapted to be low in height while the second side wall 12 is adapted to be higher than the former, and the tip of the guide part is substantially triangle-shaped in cross-section. Two inwardly directed projections 22 are provided on the tip of the second side wall 21, and a slit 23 is formed in the second side wall 21 between the two projections 22. The slit 23 is not needed to be provided over the whole length of the guide part 12, and it is sufficient to be formed in at least at the L-shaped top end of the guide part.

The bias tape supply device according to the present invention is divided into an upper and a lower part and the parts are joined with each other, so that the guide part 12 is also formed in upper and lower parts. Accordingly, it is desired to employ the slit 23 as a joint between the upper and lower portions of the device.

The bottom circular wall 14 of the housing part 11 and the lower wall 19 of the guide part 12 are kept horizontal and integrally formed with each other, and likewise the lower wall 19 of the guide part 12 and the lower side of the slit 23 notched in the second side wall 21 are integrally formed to provide a lower cover side C. The top circular wall 13 of the housing part 11, and the upper wall 18, the first side wall 20 and the part of the second side wall 21 above the slit 23 are integrally formed, while the circumferential wall 15 of the housing part 11 is formed integrally with the top circular wall 13 in the present embodiment to provide a vessel side V. In addition, the circumferential wall 15 may be formed to be integral with the bottom circular wall 14 of the housing part 11.

A circumferential short upstanding part 24 is provided on the bottom circular wall 14 of the housing part 11. The upstanding part 24 is fitted in a recessed annular surface 25 provided in the circumferential wall 15, whereby the vessel side V is covered with the cover side C and fixed in place.

Figure 4:
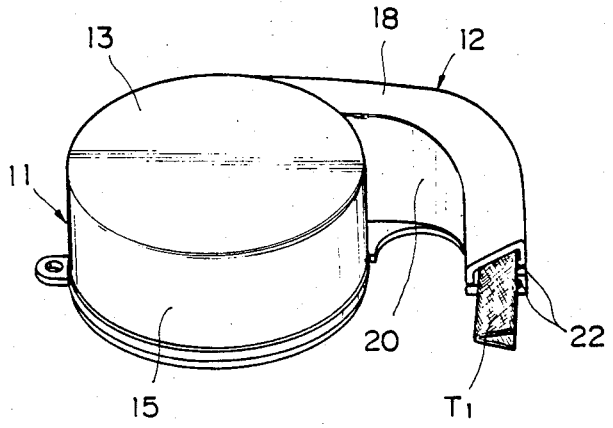
FIG. 4 is a perspective view illustrating the delivery of the bias tape from the device.
Figure 5:
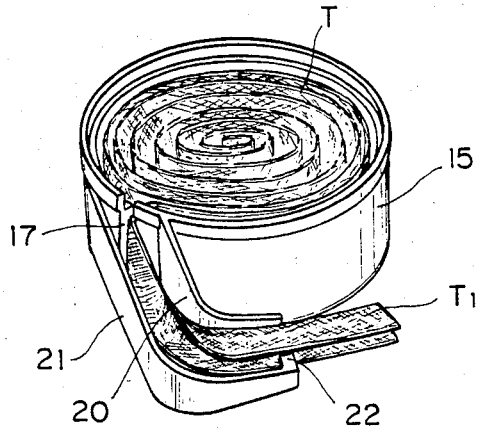
FIG. 5 is a perspective view illustrating the details of the delivery of bias tape from the device with the interior of the upper housing and guide show.
Figure 6:
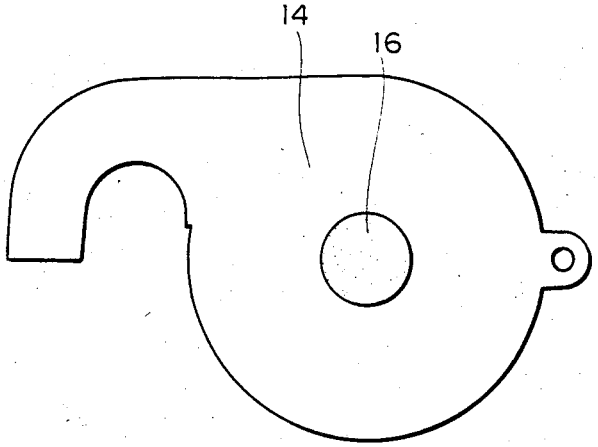
FIG. 6 is a plan view illustrating the bottom cover side as viewed from the back thereof.
Figure 7:
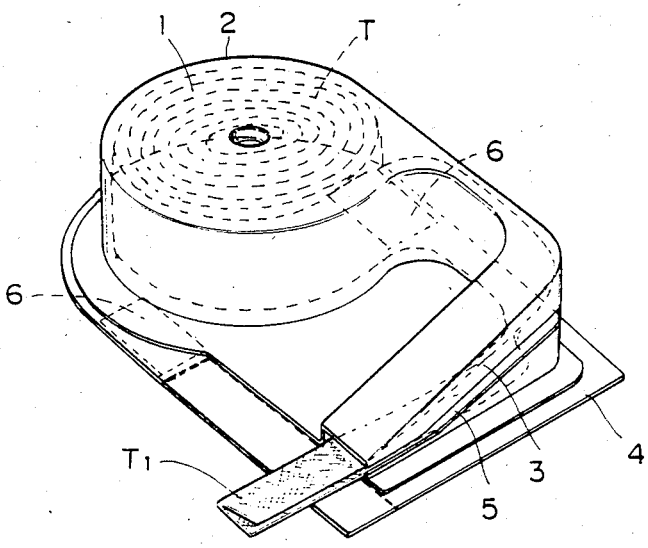
FIG. 7 is a perspective view illustrating a prior art bias tape supply deive.

Operation of the bias tape supply device described above is as follows:

Referring to FIGS. 4 and 5, the bias tape T is housed in the vessel side V, and part of the tape is allowed to pass through the slit 17 and the guide part 12, and exits from the tip of the guide part as shown by $T_1$. The bias tape T is folded over in the vicinity of the tip of the guide part 12. After the vessel side V is covered with the cover side C, the ends of the bias tape $T_1$ folded over are inserted into the space between the projections 22 on the tip of the guide part 12 and the upper wall 18 and lower wall 19. The bias tape supply device is fixed on a prescribed portion of a sewing machine with the magnet 16 (shown in FIG. 6), and the bias tape T can be successively delivered with the progress of the biassing operation.

With the arrangement of the present invention, the lower cover side and the vessel side are made detachable. Accordingly, when a bias tape is used up, a new bias tape can be inserted in the vessel, and the device can be reused any number of times, and be of low-cost because the tape supply device is not employed disposably.

The bias tape supply device is fixed at a prescribed position on a sewing machine by a magnet. Consequently, the ability of the device to stay fixed remains unchanged even if it is mounted or demounted many times.

The projections provided on the tip of the guide part allow both ends of the bias tape to be held and positioned. Accordingly, the bias tape can be delivered without fail while folded in two, simplifying and facilitating the biassing operation by a sewing machine.

In addition, the guide part is made of a thick synthetic resin material. Accordingly, the bias tape supply device is not damaged and durable for long-term application thereof.

What is claimed is:

1. A bias tape supply device comprising: a housing and a tape-dispensing guide part, said housing comprising upper and lower circular walls superimposed in spaced-apart relation with each other, a cylindrical circumferential wall extending therebetween but reserving a circumferentially unwalled space, thereby forming a vessel for containment of the bias tape, said guide part having an overall L-shape and being adapted to extend from said cylindrical circumferential wall at said unwalled space outwardly to thereby form a passageway for the bias tape, said guide part comprising a base end thereof located at said unwalled space, spaced-apart, upper and lower walls, and sapced-apart first and second side walls joining said upper and lower walls and a tape outlet tip for passage and application of the bias tape forming an end of said guide part, said outlet tip being disposed a predetermined distance away from said base end, wherein said side walls gradually decrease in height in the direction toward said tip, with said first side wall retaining a greater height than the second side wall thereby imparting said tip with a substantially triangular cross-section for imparting a substantially folded-over form to the tape at said outlet tip, said first side wall having a pair of projections extending in the direction of said second side wall at the tape outlet tip for guiding the bias tape from said device, and a slit formed in the first side wall between said projections.

2. A bias tape supply device, as claimed in claim 1, wherein said lower circular wall of said housing and said lower wall of said guide part are formed integrally with each other and are maintained in horizontal relationship as a lower unit, and said upper circular wall, and cylindrical wall, of said housing and said upper wall and side walls of said guide part are formed integrally with one another as an upper unit, wherein said lower and upper units are detachably engageable one another by means of a short upstanding wall about the lower circular wall adapted for detachable engagement with a recess annular surface on said cylindrical circumferential wall.

3. A bias tape supply device, as claimed in claim 1, wherein said housing has a magnet attached thereto to facilitate magnetic attachment of said housing to a surface.

4. A bias tape supply device comprising: a housing and a tape-dispensing guide part, said housing comprising upper and lower circular wall superimposed in spaced-apart relation with each other, a cylindrical circumferential wall extending therebetween but reserving a circumferentially unwalled space, thereby forming a vessel for containment of the bias tape, said guide part having an overall L-shape and being adapted to extend from said cylindrical circumferential wall at said unwalled space outwardly to thereby form a passageway for the bias tape, said guide part comprising a base end thereof located at said unwalled space, spaced apart upper and lower walls, spaced-apart first and second side walls joining said upper and lower walls and a tape outlet tip for passage and application of the bias tape forming an end of said guide part, said outlet tip being disposed a predetermined distance away from said base end, wherein said side walls gradually decrease in height in the direction toward said tip, with the first side wall retaining a greater height than the second side wall thereby giving said tip a substantially triangular cross-section for imparting a substantially folded-over form to the tape at said outlet tip, said first side wall having a pair of projections extending in the direction of said second side wall at the tape outlet tip for guiding the bias tape from said device, and a slit formed in said first side wall between said projections, wherein said lower circular wall of said housing and said lower of said guide part are formed integrally with each other and are maintained in horizontal relationship as a lower unit, and said upper circular wall, and cylindrical wall, of said housing and said upper wall and side walls of said guide part are formed integrally with one another as an upper unit, said upper and lower units being adapted for detachable engagement with one another for facilitating resupply of the bias tape supplied therefrom.

5. A bias tape supply device, as claimed in claim 4, wherein said housing has a magnet attached thereto to facilitate magnetic attachment of said housing to a surface.

* * * * *

UNITED STATES PATENT AND TRADEMARK OFFICE

CERTIFICATE OF CORRECTION

PATENT NO. : 4 658 959

DATED : April 21, 1987

INVENTOR(S) : Shigehiro INOUE

It is certified that error appears in the above-identified patent and that said Letters Patent is hereby corrected as shown below:

Column 4, line 44; change "sapced" to ---spaced---.

Column 5, line 3; change "recess" to ---recessed---.

Column 5, line 11; change "wall" to ---walls---.

Column 6, line 12; after "lower" insert ---wall---.

Signed and Sealed this

Fifteenth Day of September, 1987

*Attest:*

DONALD J. QUIGG

*Attesting Officer* *Commissioner of Patents and Trademarks*